US007922638B2

(12) United States Patent
Draghetti et al.

(10) Patent No.: US 7,922,638 B2
(45) Date of Patent: Apr. 12, 2011

(54) MACHINE FOR MANUFACTURING COMPOSITE FILTERS

(75) Inventors: Fiorenzo Draghetti, Medicina (IT); Salvatore Rizzoli, Bologna (IT)

(73) Assignee: G.D S.p.A. (IT)

( * ) Notice: Subject to any disclaimer, the term of this patent is extended or adjusted under 35 U.S.C. 154(b) by 369 days.

(21) Appl. No.: 11/599,330

(22) Filed: Nov. 15, 2006

(65) Prior Publication Data

US 2007/0107740 A1 May 17, 2007

(30) Foreign Application Priority Data

Nov. 16, 2005 (IT) ..... BO2005A0696

(51) Int. Cl.
*B31C 99/00* (2009.01)

(52) U.S. Cl. ..... 493/39; 493/44; 493/50

(58) Field of Classification Search ..... 493/39, 493/42, 44, 48, 50; 131/29, 27.1, 32, 57, 131/58

See application file for complete search history.

(56) References Cited

U.S. PATENT DOCUMENTS 4,506,779 A * 3/1985 Seragnoli ..... 198/459.1
5,349,968 A * 9/1994 Rizzoli et al. ..... 131/94
5,887,595 A * 3/1999 Draghetti et al. ..... 131/29
6,736,257 B2 5/2004 Steiniger
7,226,404 B2 * 6/2007 Rizzoli et al. ..... 493/48
7,530,444 B2 * 5/2009 Draghetti et al. ..... 198/474.1
2004/0237972 A1 12/2004 Horn
2006/0213528 A1 9/2006 Draghetti

FOREIGN PATENT DOCUMENTS

EP 0580150 1/1994
EP 1 287 753 A1 3/2003
EP 1 704 788 A 9/2006

* cited by examiner

*Primary Examiner* — Sameh H. Tawfik
(74) *Attorney, Agent, or Firm* — Timothy J. Klima; Shuttleworth & Ingersoll, PLC

(57) ABSTRACT

Composite filters are assembled initially by an upstream unit as groups of at least two plugs having different filtration properties. A single flow of the groups is directed from the assembling unit onto a pair of drums and divided into two flows, whereupon these are taken up by two pitch-adapting drums rotating substantially tangential one to another about parallel axes, and released to a rotating member turning on an axis normal to the axes of the drums and equipped with a plurality of carriers by which pairs of the groups are transferred from the drums to the twin channels of a garniture tongue along which two continuous rods of composite filters are formed. The carriers are equipped with an arm presenting a portion angled relative to the axis of the rotating member, so that two groups can be picked up at a time from the drums and deposited simultaneously in the channels.

18 Claims, 4 Drawing Sheets

MACHINE FOR MANUFACTURING COMPOSITE FILTERS

BACKGROUND OF THE INVENTION

The present invention relates to a machine for the manufacture of composite filters.

Conventionally, the harmful effects of inhaling cigarette smoke are reduced by tipping cigarettes with composite filters, that is to say with filters obtainable by pairing together two or more filter plugs made of material having different filtration characteristics.

In the case of composite filters incorporating two filter plugs, for example, these are prepared employing machines in which first and second plugs dispensed from separate reservoirs are transferred along a direction transverse to their longitudinal axes, by respective trains of fluted rollers, onto a common take-up roller with peripheral flutes.

Each flute will therefore accommodate a single filter element consisting of two axially aligned plugs having different characteristics.

These composite filter elements, made up of plugs placed in end-to-end contact, are then transferred by rotary transfer means onto a garniture tongue and fashioned into a filter rod. Proceeding singly and in succession on the tongue, more exactly, the filter elements advance in end-to-end contact along a direction parallel with their longitudinal axes and are wrapped in a strip of paper material to form a continuous filter rod.

The rod is divided up subsequently into single composite filters by a rotary cutter operating at the outfeed end of the garniture tongue.

In reality, these machines of conventional type for manufacturing composite filters betray serious limitations in terms of production speed.

More precisely, it has been found that they are not able to match the output speeds generated by cigarette makers and filter tip attachment machines of the latest generation, and therefore cannot be linked up directly to these same machines.

The object of the present invention is to provide a machine for manufacturing composite filters, such as will be unaffected by the above noted drawback.

A further object of the invention is to provide a machine for making composite filters, which in the event of a change in production size, that is to say in the length of the composite filter, will be able to guarantee that the filters are correctly positioned on the garniture tongue.

SUMMARY OF THE INVENTION

The stated object is realized according to the present invention in machine for manufacturing composite filters, comprising a unit by which filter plugs having different filtration properties are assembled in axial alignment to form composite groups; conveyor means with flutes, by which the groups of plugs are taken up singly and caused to advance in a direction transverse to their own axes; a garniture tongue with two channels extending parallel one to another and substantially parallel also to the flutes of the conveyor means; rotary cutting means by which two continuous filter rods formed in the channels of the tongue are divided up into single composite filters; and a rotating member, centered on an axis extending transversely to the channels of the tongue and equipped with a plurality of carriers by which pairs of the groups of plugs are transferred from the conveyor means to the two channels, in such a way as to form two continuous successions of groups in the channels.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
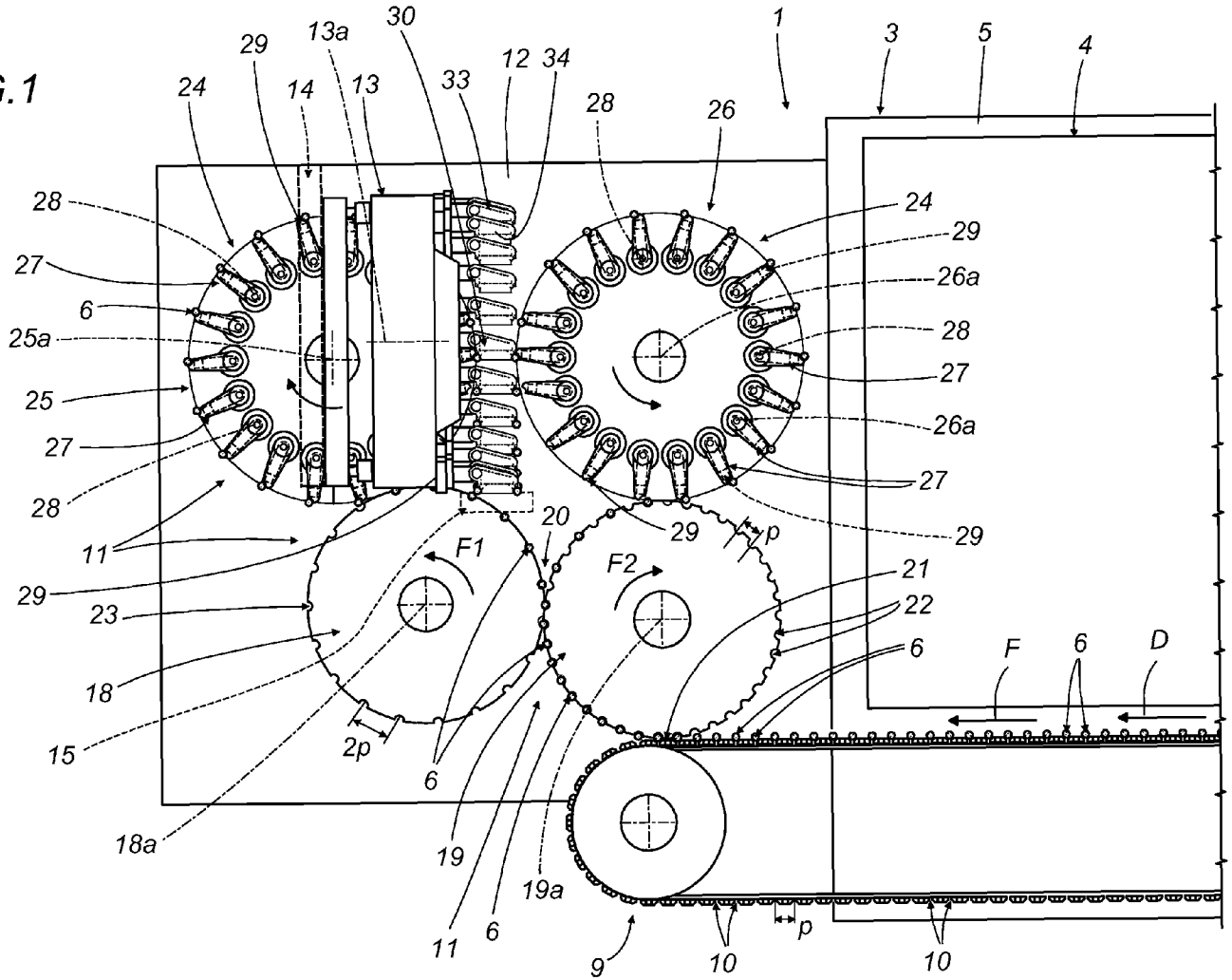
FIG. 1 illustrates a portion of a twin track machine for manufacturing composite filters, viewed partly as a block diagram and in a front elevation.
Figure 2:
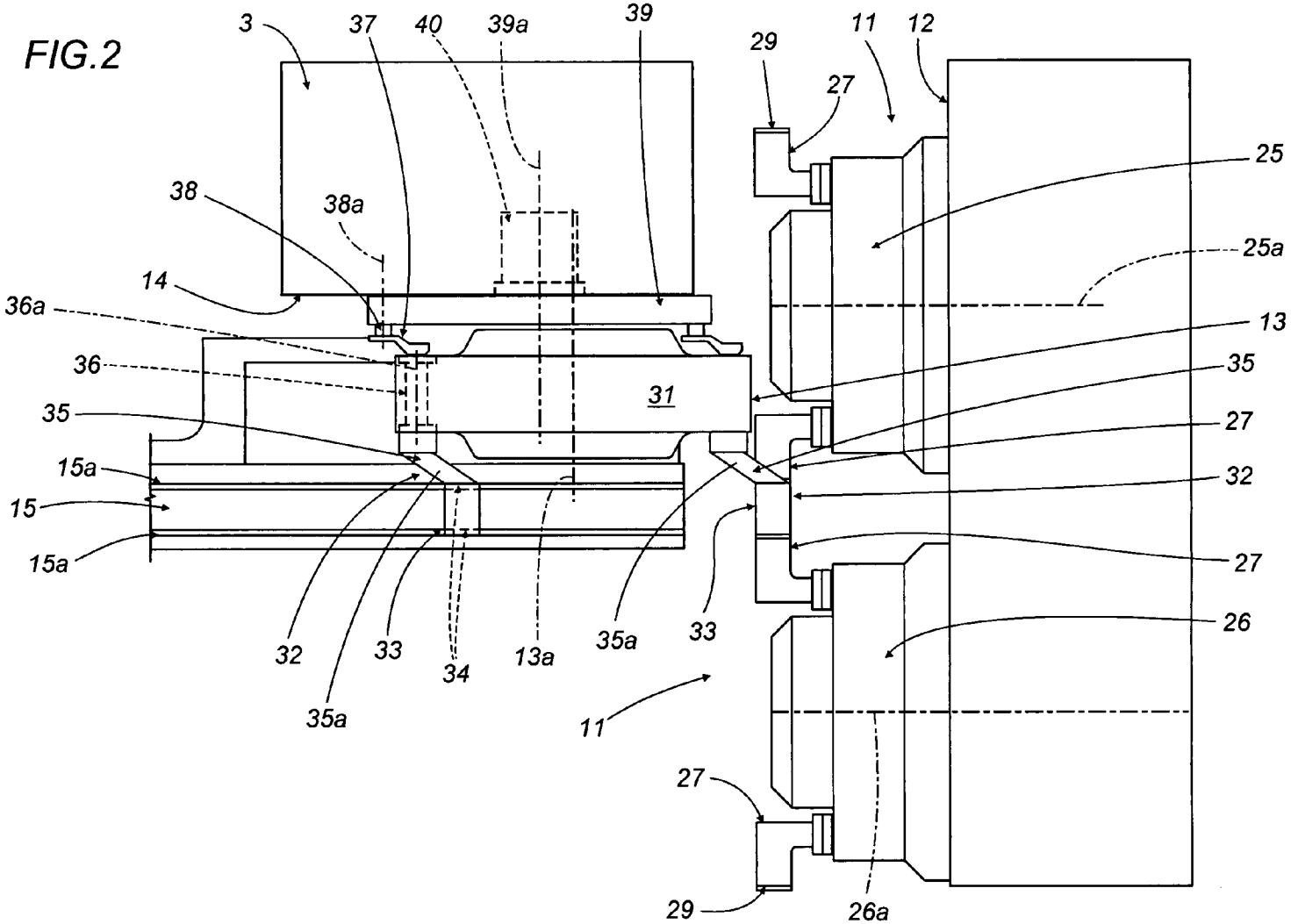
FIG. 2 is a schematic plan view showing the portion of the machine in FIG. 1.
Figures 3, 4:
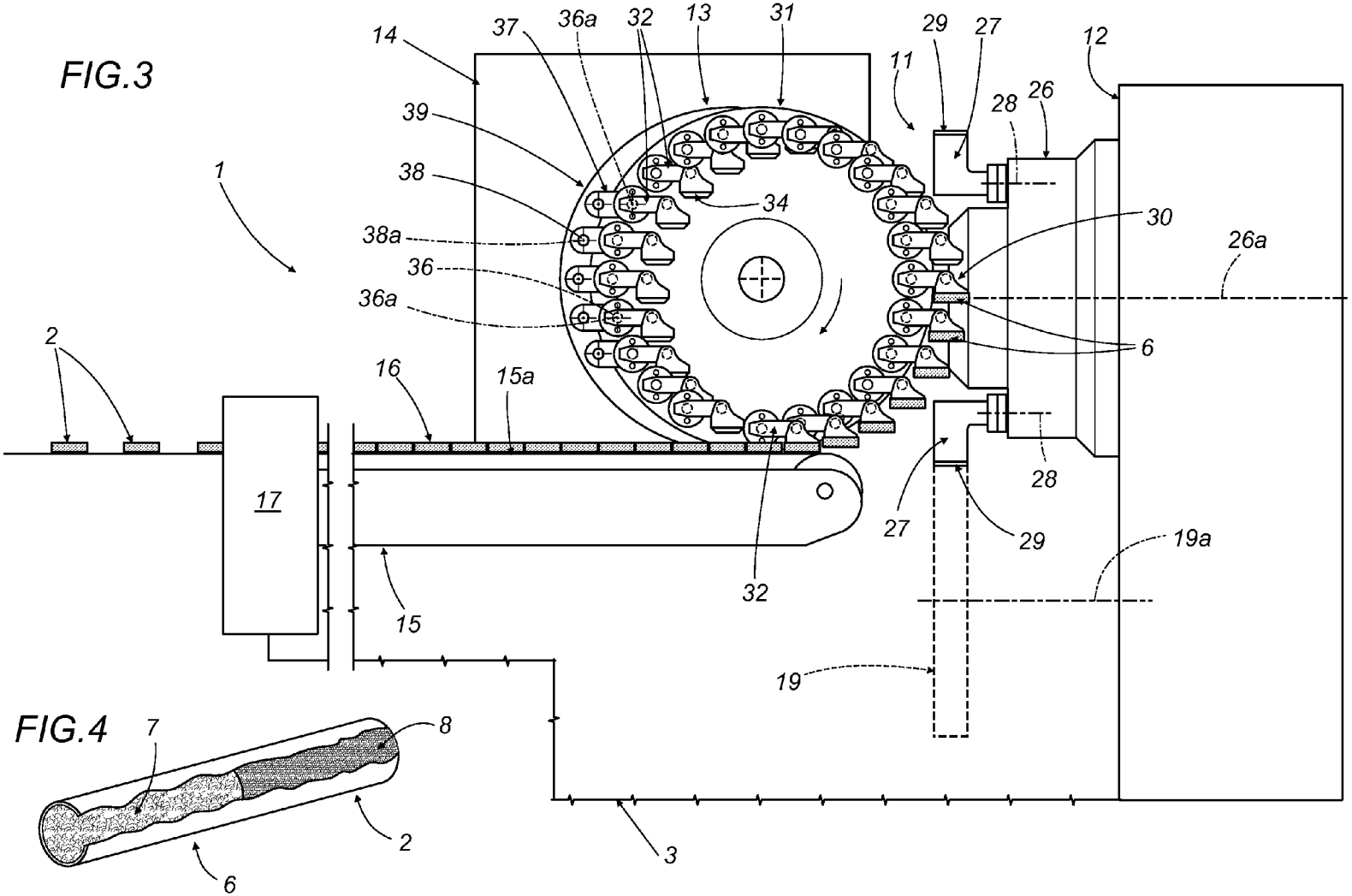
FIG. 3 is a front elevation view showing a further portion of the machine in FIG. 1.
FIG. 4 illustrates a composite filter made by the machine according to the present invention, viewed enlarged and in perspective.

With reference to FIGS. 1, 2 and 3, numeral 1 denotes a twin track machine, in its entirety, for manufacturing composite filters 2. The machine 1 incorporates a frame 3 and comprises an assembling unit, denoted schematically by a block 4, carried by a bulkhead 5 of the frame 3.

The function of the assembling unit 4 is to prepare groups 6 of filter plugs having different filtration properties, disposed in axial alignment and in end-to-end contact one with another.

In the example of FIG. 4, each group 6 is made up of two plugs, denoted 7 and 8 respectively.

The assembling unit 4 comprises a belt type outfeed conveyor 9 presenting flutes 10 disposed transversely to the conveying direction, denoted D, by which single groups 6 of the aforementioned filter plugs are accommodated and advanced in a continuous flow F toward the runout end of the conveyor 9.

The machine 1 comprises conveyor means denoted 11 in their entirety, carried by a plate 12 occupying substantially the same plane as the bulkhead 5, by which the groups 6 are transferred in a direction transverse to their own axes.

Also forming part of the machine 1 are a rotating member denoted 13, centered on a relative axis 13*a* and mounted to a bulkhead 14 set at right angles to the main bulkhead 5, a garniture tongue 15 carried by the frame 3, affording two parallel channels 15*a* along which two continuous filter rods 16 are formed, and rotary cutting means positioned at the outfeed end of the tongue 15, shown schematically in FIG. 3 as a block 17, by which the continuous rods 16 are divided up into composite filters 2.

The conveyor means 11 comprise means by which to divide the flow F of groups 6 running off the belt conveyor 9, embodied as a pair of rotating drums denoted 18 and 19, positioned respectively left and right as viewed in FIG. 1.

The drums 18 and 19 are centered on axes 18*a* and 19*a* parallel to the flutes 10 of the conveyor 9 and rotatable in opposing directions, anticlockwise and clockwise respectively, revolving substantially tangential one to another at a position denoted 20.

The right hand drum 19 (FIG. 1), which also rotates tangentially to a runout end 21 of the belt conveyor 9, is furnished with peripheral aspirating flutes 22 spaced at a pitch p identical to that of the flutes 10 presented by the belt conveyor 9, whilst the left hand drum 18 is furnished with peripheral flutes 23 spaced at a longer pitch 2p, double the pitch p of the conveyor flutes 10.

The aspirating flutes 22 and 23 are connected to suction means of conventional type, and the shorter pitch flutes 22 can be deactivated selectively by a signal from a control unit of familiar type (not illustrated), in such a way that the flow F from the belt conveyor 9 will be divided beyond the position of tangency 20 to create a first flow F1 on the one drum 18 and a second flow F2 on the other drum 19.

The conveyor means 11 further comprise pitch-adapting means 24 provided by two drums 25 and 26, positioned left and right respectively (FIG. 1), centered on respective axes 25*a* and 26*a* parallel to the axes 18*a* and 19*a* of the two drums 18 and 19 first mentioned, and set in rotation substantially tangential to these same drums, turning clockwise and anti-clockwise respectively.

Each drum 25 and 26 is furnished peripherally with a plurality of arms 27 pivoting on axes 28 parallel to the axis 25*a* and 26*a* of rotation, each arm 27 in turn being equipped with an aspirating flute 29 at the free end proportioned to admit one group 6 of plugs.

The function of the two pitch-adapting drums 25 and 26 is, through the agency of the arms 27, to transfer the groups 6 from respective positions of tangency with the first drums 18 and 19 to a position 30 of minimum distance between the arms 27 of the two drums 25 and 26, whereupon the groups 6 are transferred to the rotating member 13.

Supported by the relative bulkhead 14 of the frame 3, as shown in FIGS. 2 and 3, the rotating member 13 comprises a first rotating body 31 turning about the aforementioned axis 13*a*, furnished at the periphery with a plurality of carriers 32, equispaced angularly and rotatable about respective axes, by which the groups 6 are transferred in pairs from the conveyor means 11 to the channels 15*a* of the garniture tongue 15.

Each carrier 32 comprises a pick-up head 33 with two mutually parallel flutes 34 accommodating two groups 6, mounted to a first end of an arm 35 that presents an inclined portion 35*a* and is anchored at a second end to a shaft 36 of which the axis 36*a* lies parallel to the centre axis 13*a*.

The shaft 36 is insertable freely through the rotating body 31, together with interposed means of familiar type (not illustrated) allowing its rotation.

The free end of each shaft 36 projects toward the bulkhead 14 and is connected by way of a lever 37 to a pin 38 extending parallel with the shaft 36 and supported, together with interposed means of familiar type (not illustrated) allowing its rotation, by a second body 39 set in rotation about a relative axis 39*a* through the agency of actuator means associated with the frame 3 and indicated schematically by a block denoted 40.

The centre axes 13*a* and 39*a* of the two rotating bodies 31 and 39 are offset by a predetermined distance identical to the distance that separates the axis 36*a* of each shaft 36 from the axis 38*a* of the relative pin 38.

The mechanism thus described, which in practice constitutes a Schmidt type coupling familiar to a person skilled in the art, is set up in such a way that when the two rotating bodies 31 and 39 turn on their axes, the flutes 34 of the carriers 32, which are cantilevered from the first rotating body 31 and parallel one with another, will be maintained substantially horizontal by the action of the linkage components 36, 37, 38 and 39 described above.

Observing FIGS. 1 and 2, it will be seen that the pitch-adapting drums 25 and 26 are positioned symmetrically, relative to the trajectory described by the heads 33 of the carriers 32.

More exactly, the particular architecture and the arrangement of the rotating bodies 31 and 39 are such that each pick-up head 33 passing through the transfer position 30 is able to interact with two arms 27 presented simultaneously by the respective drums 25 and 26, and pick up two groups 6 of filter plugs.

To avoid interference between the carriers 32 and the arms 27 of the drums 25 and 26, advantageously, the inclined portion 35*a* of the carrier arms 35 is set at an angle of at least between 50° and 60° relative to the axis 13*a* of the rotating body 31, and preferably 55°.

In operation, groups 6 of filter plugs with different filtration characteristics emerging from the outfeed belt conveyor 9 in a single flow F are ordered into two flows F1 and F2 by the two dividing drums 18 and 19, and directed by the pitch-adapting drums 25 and 26 to the transfer position 30 of the rotating member 13, remaining parallel with the position occupied on the belt and without deviating from the horizontal.

As the drums 25 and 26 rotate, the respective arms 27, which are made to pivot on their axes 25*a* and 26*a* by relative cam means not indicated in the drawings, will adapt the pitch of the respective groups 6 so as to match the distance between the flutes 34 presented by successive pick-up heads 33 of the rotating member 13.

The groups 6 are transferred in pairs by the member 13 to the channels 15*a* of the tongue 15, in such a way as to form two continuous successions of groups 6 advancing in end-to-end contact.

Figure 5:
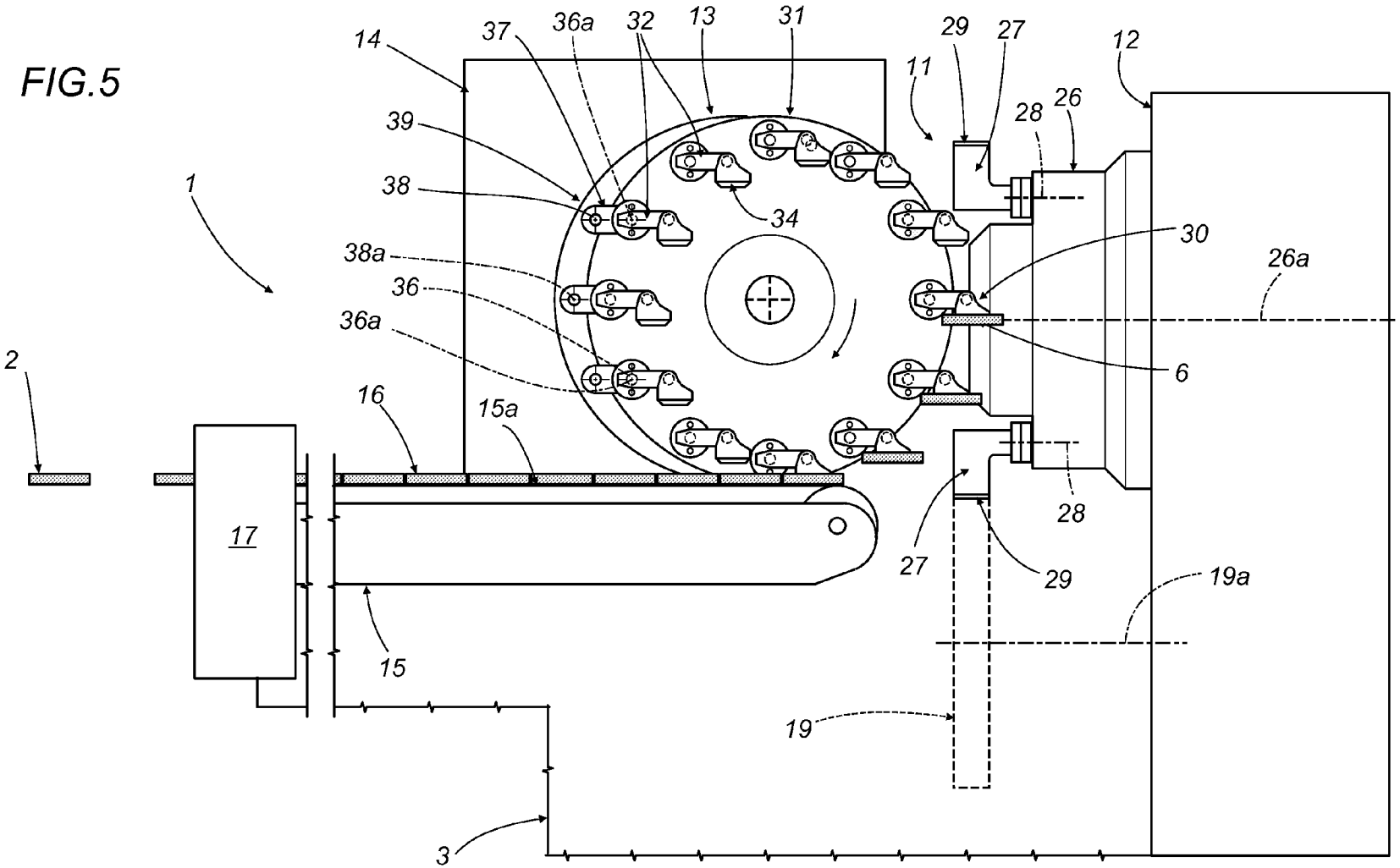
FIG. 5 is a front elevation view showing the machine in FIG. 3 in a different configuration according to a changeover size of the filters to be manufactured.

In the case of a size changeover as illustrated in FIG. 5, that is, a change in the length of the group 6 of filter plugs, the number of carriers 32 will be varied accordingly. More exactly, in the event that the new group 6 is longer than that indicated by way of example in FIG. 3, then the rotating member 13 will be fitted with a number of carriers 32 correspondingly less than in FIG. 3. This guarantees correct positioning of the groups 6 along the channels 15*a* of the tongue 15 and ensures they are maintained in end-to-end contact.

What is claimed is:

1. A machine for manufacturing composite filters, comprising:

an assembly unit by which filter plugs having different filtration characteristics are assembled to form composite groups of plugs;

a conveyor positioned downstream of the assembly unit and having a plurality of flutes by which composite groups of plugs are accommodated singly and advanced in a vertically oriented plane transverse to the axes of the groups of plugs;

a rotating member positioned downstream of the conveyor and rotating around a horizontal rotation axis transverse to the axes of the groups of plugs, the rotating member having a plurality of carriers acting on the composite groups of plugs advanced by the conveyor to transfer the composite groups of plugs from the conveyor to a garniture tongue;

the garniture tongue being positioned downstream of the rotating member and having two channels extending parallel to each other and to the axes of the groups of plugs and transversal to the rotation axis of the rotating member;

a stream of the groups of plugs remaining in a same vertical plane between receipt into the plurality of carriers respectively and deposit into one of the channels of the garniture tongue; and a rotary cutter by which two continuous filter rods formed in the channels of the garniture tongue are divided up simultaneously into single composite filters.

2. A machine as in claim 1, wherein:

the conveyor includes a dividing mechanism positioned between the assembly unit and the rotating member by which a single flow of groups emerging from the assembly unit is divided into a first flow and a second flow;

the dividing mechanism includes a first rotating drum and a second rotating drum generally tangential to each other at a transfer point between the two drums and both rotating around respective axes parallel to each other and to the axes of the groups of plugs;

the first rotating drum comprises a plurality of angularly equally spaced flutes positioned on a peripheral portion of the first rotating drum and the second rotating drum each a plurality of angularly equally spaced flutes positioned on a peripheral portion of the second rotating drum, each flute accommodating a single group of plugs;

the second rotating drum receives each of the single flow of groups emerging from the assembly unit, one group to a flute, so that each group emerging from the assembly unit is initially spaced from a subsequent group by a pitch P;

the first rotating drum removes into its flutes every alternating group from the second rotating drum at the transfer point to divide the single flow of groups emerging from the conveyor into the first flow being conveyed by the first rotating drum and the second flow being conveyed by the second rotating drum, with a pitch between adjacent groups on each of the first rotating drum and the second rotating drum downstream of the transfer point being twice the pitch P because of the transfer of every alternate group from the second rotating drum to the first rotating drum.

3. A machine as in claim 2, comprising a pitch-adapting mechanism interposed between the dividing mechanism and the rotating member.

4. A machine as in claim 3, wherein the pitch-adapting mechanism comprises a third rotating drum interposed between the first drum and the rotating member, a fourth rotating drum interposed between the second drum and the rotating member, and pluralities of arms associated with each of the third and fourth drums, pivotable about respective axes disposed parallel to the axes of rotation of the drums, by which the single groups of the first flow and of the second flow are transferred from the dividing mechanism to the carriers of the rotating member.

5. A machine as in claim 4, wherein the third and fourth rotating drums are positioned symmetrically in relation to a trajectory described by the carriers.

6. A machine as in claim 5, wherein each of the transfer carriers comprises an arm mounted pivotably about a respective axis of rotation parallel to the axis of rotation of the rotating member, of which one end supports a pick-up head having two aspirating flutes such as will admit and retain a pair of groups of filter plugs at a transfer station and release the groups to the tongue.

7. A machine as in claim 6, wherein the rotating member comprises a mechanical mechanism by which to adjust an angular position of each assembly about a relative axis of rotation, such that the aspirating flutes are maintained parallel with one another and with the channels of the tongue during the rotation of the rotating member.

8. A machine as in claim 7, wherein each arm includes at least one inclined portion supporting the pick-up head.

9. A machine as in claim 8, wherein an angle of the inclined portion presented by the arm is between 50° and 60°.

10. A machine as in claim 9, wherein an angle of the inclined portion is approximately 55°.

11. A machine as in claim 2, wherein each carrier of the rotating member includes two separate flutes to receive groups of plugs from the first flow and the second flow respectively to create two streams of groups of plugs from the conveyor to the garniture tongue, each stream of the groups of plugs remaining in a same respective vertical plane between receipt into the plurality of carriers and deposit into one of the channels of the garniture tongue.

12. A machine as in claim 3, wherein the rotating member comprises a mechanical mechanism by which to adjust an angular position of each assembly about a relative axis of rotation, such that the flutes are maintained parallel with one another and with the channels of the tongue during rotation of the rotating member.

13. A machine as in claim 4, wherein the third and fourth rotating drums are positioned symmetrically in relation to a trajectory described by the carriers.

14. A machine as in claim 4, wherein the rotating member comprises a mechanical mechanism by which to adjust an angular position of each assembly about a relative axis of rotation, such that the flutes are maintained parallel with one another and with the channels of the tongue during rotation of the rotating member.

15. A machine as in claim 5, wherein the rotating member comprises a mechanical mechanism by which to adjust an angular position of each assembly about a relative axis of rotation, in such a way that the flutes are maintained parallel with one another and with the channels of the tongue during rotation of the rotating member.

16. A machine as in claim 5, wherein each arm includes at least one inclined portion supporting the pick-up head.

17. A machine as in claim 6, wherein each arm includes at least one inclined portion supporting the pick-up head.

18. A machine as in claim 1, wherein the rotating member comprises a mechanical mechanism by which to adjust an angular position of each assembly about a relative axis of rotation, such that the flutes are maintained parallel with one another and with the channels of the tongue during rotation of the rotating member.

* * * * *